US012496632B2

(12) United States Patent
Potocki

(10) Patent No.: US 12,496,632 B2
(45) Date of Patent: Dec. 16, 2025

(54) MANUFACTURE OF HOLLOW CORE HIGH PRESSURE VACUUM DIE CAST COMPONENTS

(71) Applicant: MAGNA INTERNATIONAL INC., Aurora (CA)

(72) Inventor: John Richard Potocki, Armada, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 0 days.

(21) Appl. No.: 18/704,155

(22) PCT Filed: Oct. 25, 2022

(86) PCT No.: PCT/US2022/047768

§ 371 (c)(1),
(2) Date: Apr. 24, 2024

(87) PCT Pub. No.: WO2023/076304

PCT Pub. Date: May 4, 2023

(65) Prior Publication Data

US 2024/0408669 A1 Dec. 12, 2024

Related U.S. Application Data

(60) Provisional application No. 63/271,355, filed on Oct. 25, 2021.

(51) Int. Cl.

| | |
|---|---|
| ***B22D 17/14*** | (2006.01) |
| ***B22C 9/10*** | (2006.01) |
| ***B22D 29/00*** | (2006.01) |

(52) U.S. Cl.
CPC ..... *B22D 17/14* (2013.01); *B22C 9/10* (2013.01); *B22D 29/005* (2013.01)

(58) Field of Classification Search
CPC ..... B22C 9/10; B22D 17/14; B22D 17/20; B22D 17/24; B22D 29/00; B22D 29/001; B22D 29/005
USPC ..... 164/61, 63, 253, 254, 256
See application file for complete search history.

(56) References Cited

U.S. PATENT DOCUMENTS

| | | | | |
|---|---|---|---|---|
| 2,205,327 A | | 6/1940 | Williams | |
| 4,458,741 A | | 7/1984 | Iyer et al. | |
| 5,053,359 A | * | 10/1991 | Loxley et al. | C30B 35/002 65/475 |
| 5,106,400 A | * | 4/1992 | Tick | C03B 37/01268 65/502 |
| 5,735,927 A | * | 4/1998 | Sanghera et al. | C03B 37/01248 65/412 |

(Continued)

*Primary Examiner* — Kevin P Kerns
(74) *Attorney, Agent, or Firm* — Dickinson Wright PLLC

(57) ABSTRACT

A component formed of metal, such as aluminum, and including a hollow core is provided. The component can be used as a cradle, rail, A-pillar, twist axle, control arm, or shock tower, for example. The component is manufactured by a high pressure vacuum die casting (HPVDC) process. To form the component with the hollow core, a blown or stamped hollow glass core is placed in a die cavity of the high pressure vacuum die casting apparatus, and the metal is melted and injected into the die cavity around the glass core. The metal is then cast and solidifies around the glass core. After the casting process, the glass core can be shattered, removed from the cast component, and recycled.

9 Claims, 6 Drawing Sheets

(56) References Cited

U.S. PATENT DOCUMENTS

| | | | | |
|---|---|---|---|---|
| 6,353,992 | B1 | 3/2002 | Mizobe | |
| 9,908,175 | B2 | 3/2018 | Bullied et al. | |
| 11,161,173 | B2 * | 11/2021 | Cheon ..... | B22D 17/2263 |
| 2003/0111202 | A1 | 6/2003 | Sparks et al. | |

* cited by examiner

Issue 1: Mass Savings Potential

| | Aluminum LPDC Open Section D2XX | Aluminum HPDC Open Section | Aluminum LPDC Hollow Core | Aluminum HPDC Closed Section |
|---|---|---|---|---|
| Picture |  |  |  |  |
| Total Cradle Mass (kg) | 11.29 | 10.88 | 10.178 | 6.38 |
| Delta % from LPDC Open Section | - | 3.6% | 9.85% | -43.5% |
| Delta % from HPDC Open Section | -3.8% | - | 6.45% | -41.4% |

MANUFACTURE OF HOLLOW CORE HIGH PRESSURE VACUUM DIE CAST COMPONENTS

CROSS-REFERENCE TO RELATED APPLICATION

This U.S. National Stage Patent Application claims the benefit of PCT International Patent Application Serial No. PCT/US2022/047768 filed Oct. 25, 2022 entitled "MANUFACTURE OF HOLLOW CORE HIGH PRESSURE VACUUM DIE CAST COMPONENTS" which claims the benefit of and priority to U.S. Provisional Patent Application Ser. No. 63/271,355 filed on Oct. 25, 2021 titled "Manufacture Of Hollow Core High Pressure Vacuum Die Cast Components," the entire disclosures of which are hereby incorporated by reference.

BACKGROUND

1. Technical Field

The invention relates to a method of manufacturing a metal component including a hollow core by high pressure vacuum die casting, and a component including a hollow core.

2. Related Art

Structural components for vehicle applications, such as cradles, rails, A-pillars, and shock towers, are often formed by casting metal, such as aluminum or an aluminum alloy. Such components are often formed with a hollow core for weight reduction and/or other benefit. A high pressure vacuum die casting process can be used to form the hollow core. The high pressure vacuum die casting process typically includes casting the metal by applying a pressure of 1 Bar to 500 Bar to the metal while the metal is under a vacuum. Attempts have been made to form the hollow core of the component by placing a salt core or an aluminum foam in the mold, and then melted metal is injected into the mold around the salt core or aluminum foam. However, the salt core is expensive and difficult to remove from the component after the high pressure vacuum die casting process. The aluminum foam is not adequate for the high temperature and pressure of the high pressure vacuum die casting process. Thus, improved methods of manufacturing metal components having a hollow core by high pressure vacuum die casting is desired.

SUMMARY

One aspect of the disclosure provides a method of manufacturing a metal component having a hollow core for a vehicle application by high pressure vacuum die casting. The method includes placing a core formed of glass in a die used for the high pressure vacuum die casting process, and then casting melted metal around the glass core to form the component. After the casting step, the glass core can be removed from the metal component to form the hollow core in the cast metal component.

Another aspect of the disclosure includes a component formed of metal which includes a hollow core and which is manufactured by the high pressure vacuum die casting process which employs the glass core.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DESCRIPTION OF EXAMPLE EMBODIMENTS

Example embodiments will now be described more fully with reference to the accompanying drawings. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
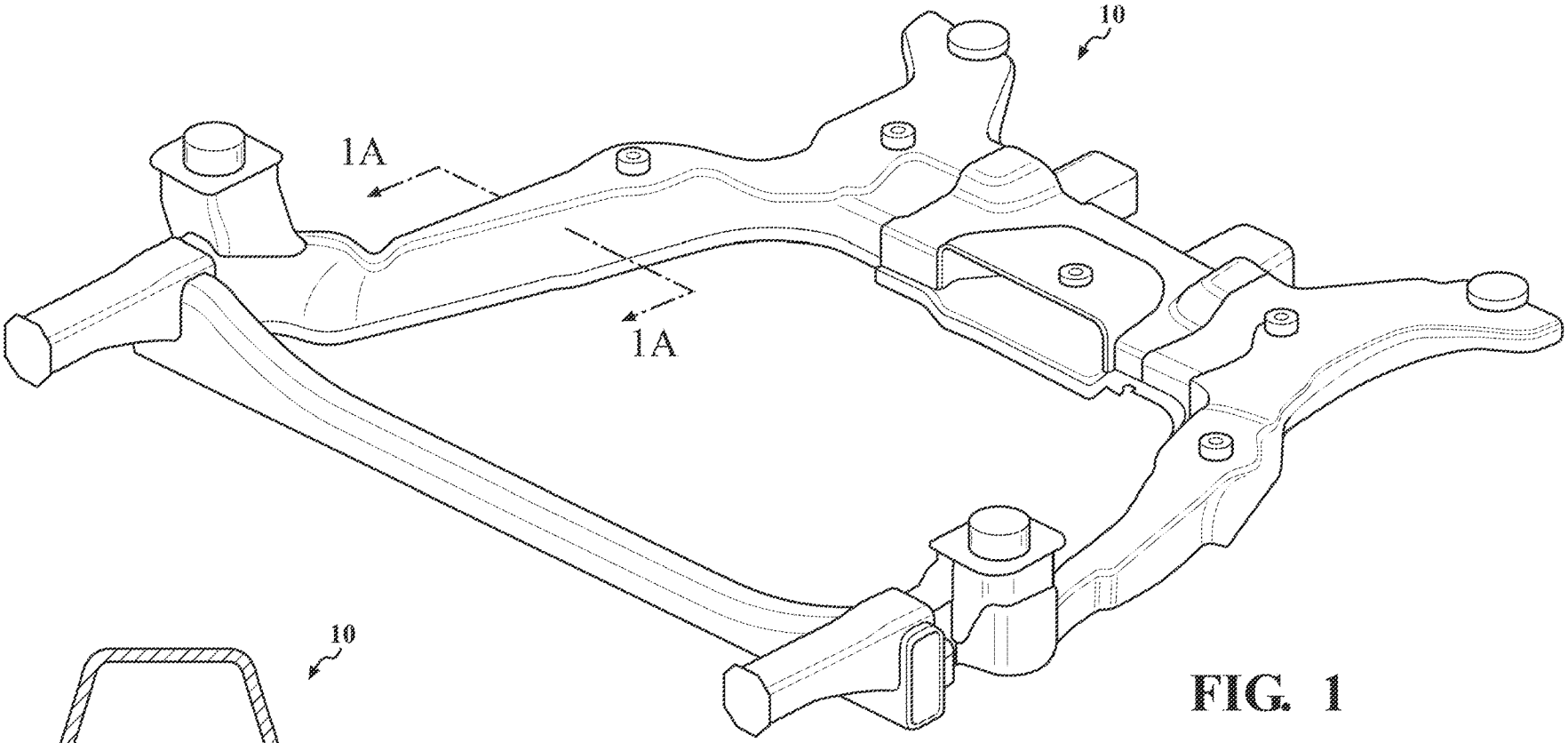
FIG. 1 illustrates a component, specifically a cradle, according to one example embodiment.
Figure 1A:
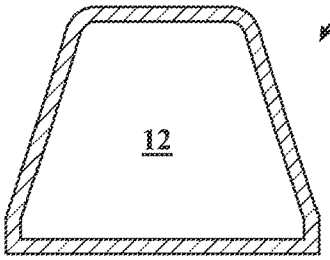
FIG. 1A is a cross-section of a portion of the component of FIG. 1.

One aspect of the disclosure provides a method of manufacturing a metal component 10 having a hollow core 12 for a vehicle application by high pressure vacuum die casting. The metal used to form the component 10 is typically aluminum or an aluminum alloy, but can be another type of metal. The component 10 formed is typically designed for use in a vehicle, for example the component 10 can be a cradle, rail, A-pillar, or shock tower. An example of the component 10, wherein the component 10 is a cradle, is shown in FIG. 1. A cross section of a portion of the component 10, specifically the cradle, including the hollow core 12 of FIG. 1 is shown in FIG. 1A.

The high pressure vacuum die casting process is conducted in an assembly including a die cavity. The die cavity has the shape of the component 10 to be formed. The high pressure vacuum die casting process includes drawing a vacuum in the die cavity, injected molten metal, such as aluminum into the die cavity. The casting step is conducted while applying pressure to the molten metal, for example 1 Bar to 500 Bar, while the metal is under a vacuum.

In order to form a hollow core 12 in the component 10, a glass core 14 is placed in the die cavity. The molten metal flows around the glass core 14 and solidifies in the die cavity while surrounding the glass core 14. After the molten metal solidifies to form the component 10, the component 10 is removed from the die cavity. The glass core 14 is broken into pieces and removed from the component 10 to form the hollow core 12 in the component 10. The component 10 is typically designed with openings to the hollow core 12 through which the glass pieces can be removed. Alternatively, the component 10 can be cast completely around the glass core 14 without any opening for removal of the glass core 14. In this case, openings for removal of the glass core 14 could be formed, for example by machining, in the component 10 after the casting step. The glass from the glass core 14 can be reused and/or recycled. The glass core 14 that is placed in the die cavity during the casting process is typically formed by stamping or blowing.

The glass core 14 includes a wall surrounding a central opening or void space, and the wall thickness depends on the strength requirements. According to an example embodiment, the wall of the glass core 14 has a thickness of 3 mm to 7 mm, for example 5 mm. The glass used to form the glass core 14 can be formed to achieve a variety of complex shapes, depending on the desired application of the glass core 14 and component 10 to be formed. The glass core 14 allows for the cast component 10 to have various different wall thicknesses. The glass core 14 can be used to create internal bulkheads or stiffeners. The glass core 14 can also be heated if solidification is an issue. The glass core 14 can also be tempered before use in the casting process. Geometric Dimensioning and Tolerancing (GD&T) features can be added for accurate and repeatable die loading. When the glass core 14 breaks, it shatters into small pieces, not shards. The glass core 14 can also be recycled and/or reused.

The glass core 14 is designed to withstand the forces of the high pressure vacuum die casting process, and designed to withstand thermal stress from the molten metal injected into the die. The glass core 14 can be formed of silicate glass, soda lime, fused quartz, borosilicate (for example Pyrex®), or alumina. The material of the glass core 14 may or may not be chemically treated for additional strength. Molten aluminum is approximately 680° C. and glass reaches its transformation phase at approximately 580° C. for soda lime glass and 820° C. for Pyrex®. According to example embodiments, the glass core 14 is formed by stamping or blowing glass and then tempering and/or chemically treating the stamped or blown glass core 14, before the glass core 14 is placed in the die cavity.

Figure 2:
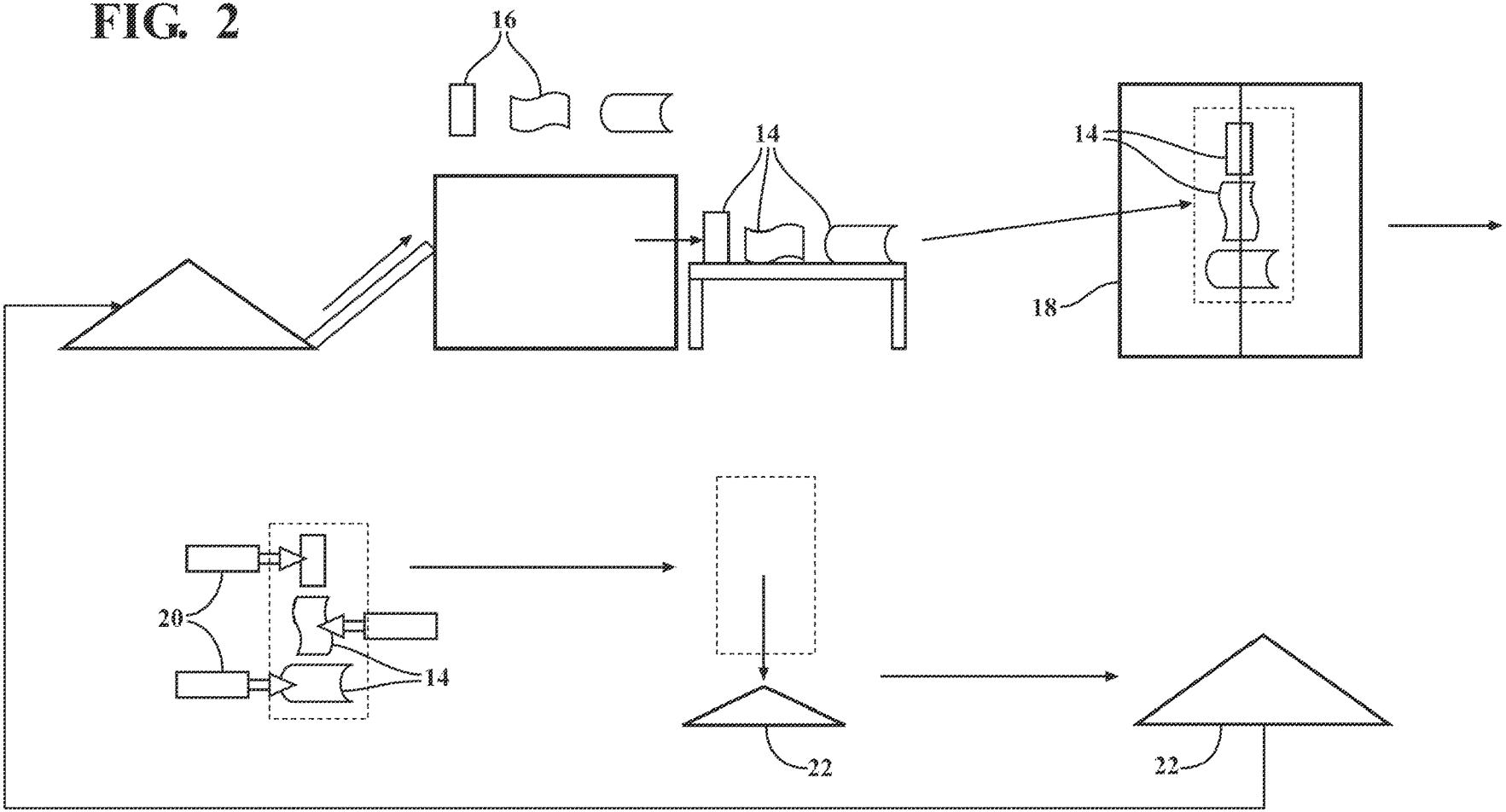
FIG. 2 illustrates a method of manufacturing a glass core and forming the component by high pressure vacuum die casting using the glass core according to an example embodiment.

An example of the process used to manufacture the glass core 14 by stamping and use of the glass core 14 in the high pressure vacuum die casting process is shown FIG. 2. In the example of FIG. 2, a first step 1 of the process includes blowing glass around a core mold 16 in a glass blowing machine to form the glass core 14. A second step 2 includes tempering the glass core 14. Step three 3 includes disposing the glass core 14 in the high pressure vacuum die casting apparatus 18, and casting the molten metal around the glass core 14 to form the component 10. The fourth step 4 includes shattering the glass core 14 by applying high speed point hammers 20 to the component 10. Step five 5 includes vibrating and rotating the cast component 10 to remove the shattered glass 22 from the component 10. The sixth step 6 includes recycling the shattered glass 22 and optionally using the recycled glass to form another glass core 14.

During the high pressure vacuum die casting process, steps should be taken to avoid breaking, typically fracturing, of the glass core 14 due to thermal shock, which is caused by uneven expansion due to a rapid temperature change. Potential ways to avoid thermal shock breakage include preheating the glass core 14 before the casting process to reduce uneven expansion; form the glass core 14 from fused silica glass or borosilicate glass, which have low coefficients of thermal expansion; applying an insulating coating to the glass core 14; and forming the glass core 14 with a consistent glass thickness. It should also be determined whether the glass core 14 can withstand the temperature, pressure, and speed at which the molten metal is injected into the casting die apparatus without experiencing thermal shock.

Figure 3:
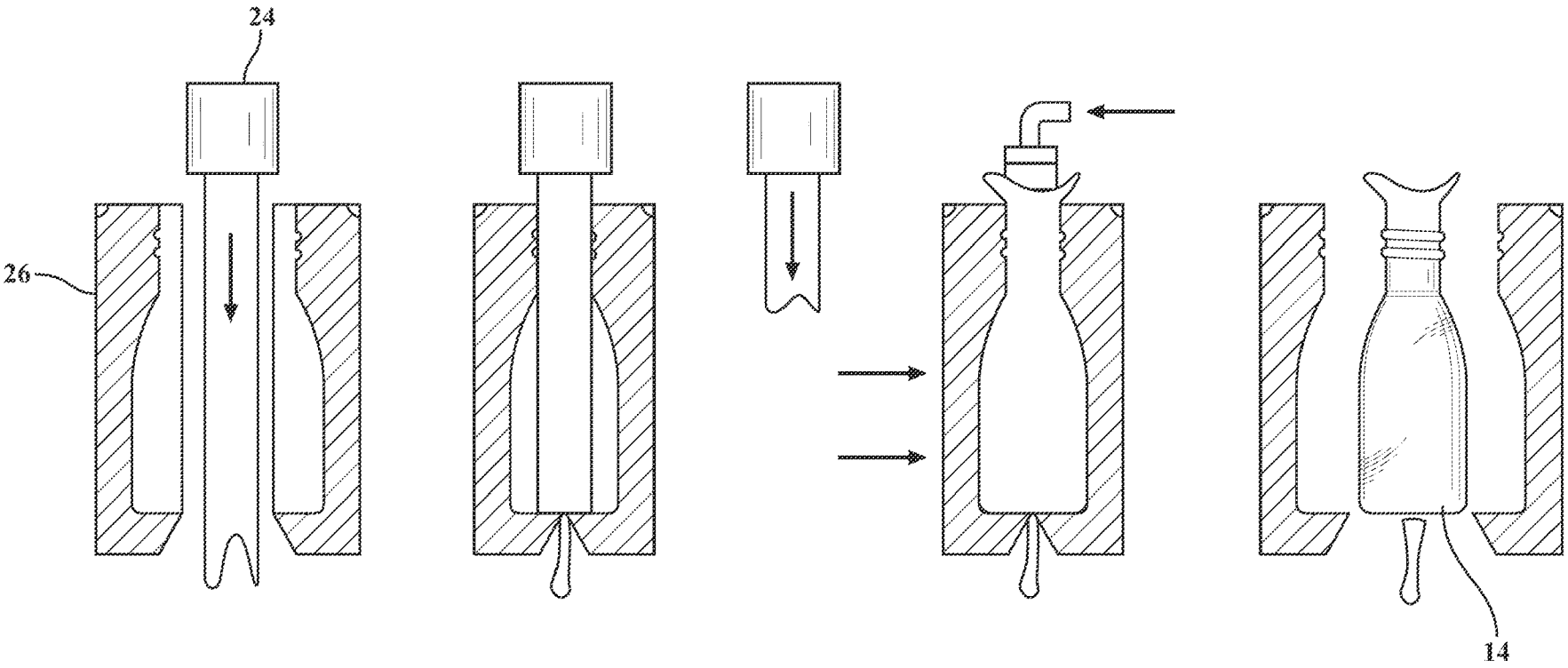
FIG. 3 illustrates a method of manufacturing the glass core according to another example embodiment.

FIG. 3 is an example of the process used to manufacture the glass core 14 in more detail. A first step 1 in the process includes an extruder 24 extruding molten glass into a mold 26 to form a parison, and a second step includes closing the mold 26. A third step includes blowing compressed air through a blow pin and into the mold to inflate the parison and form the glass core 14 while the extruder forms a new parison. A fourth step includes opening the mold 26, removing the glass core 14 from the mold 26, pinching off any glass trim, and tempering the glass core 14.

Figure 4A:
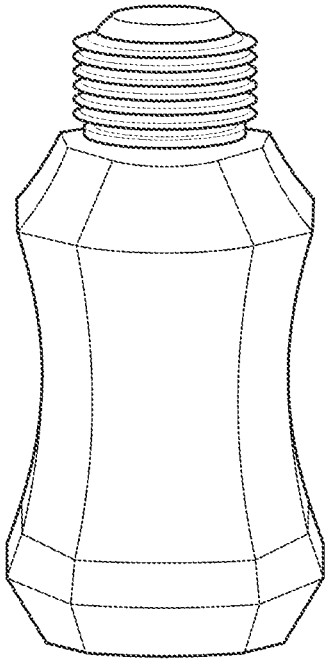
FIGS. 4A-4D includes examples of the glass cores that can be formed by blowing according to example embodiments.
Figure 4B:
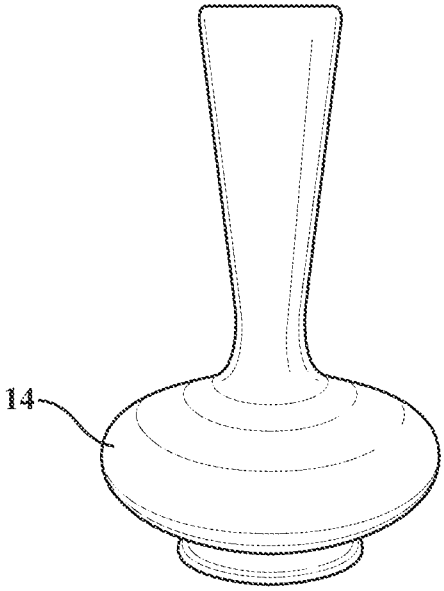
Figure 4C:
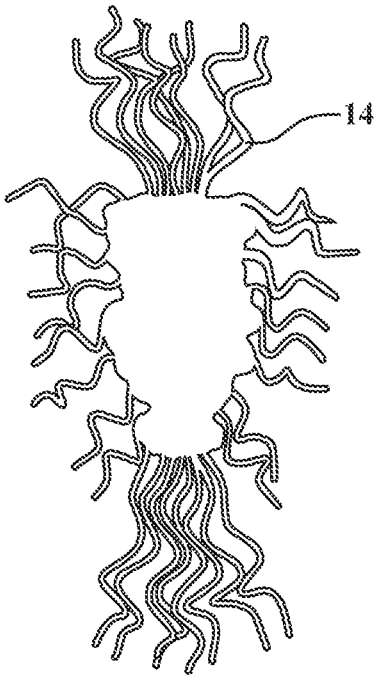
Figure 4D:
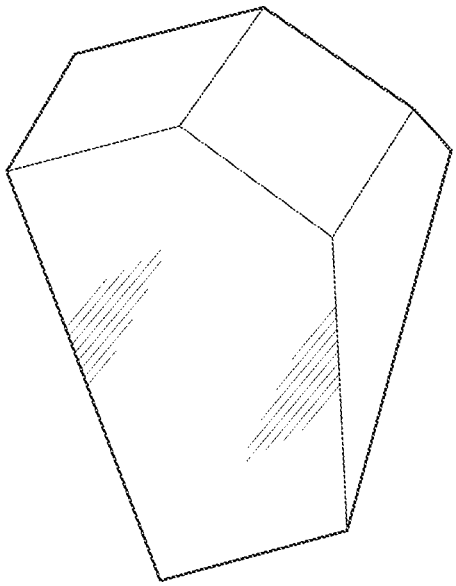

FIGS. 4-4A show examples of the glass cores 14 that can be blown. Glass blowing can be a cost effective process used to form the glass core 14. Molds used in the glass blowing process are easily changed to meet new requirements for the size and shape of the glass core.

Figure 5A:
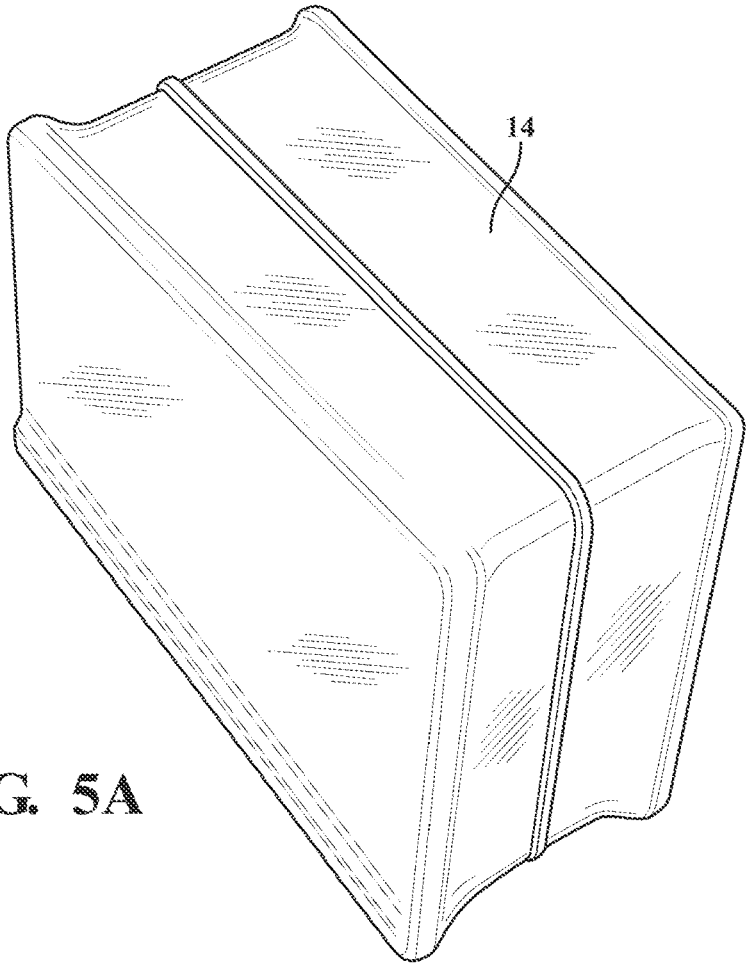
FIGS. 5A and 5B includes an example of the glass core that can be formed by stamping according to an example embodiment.
Figure 5B:
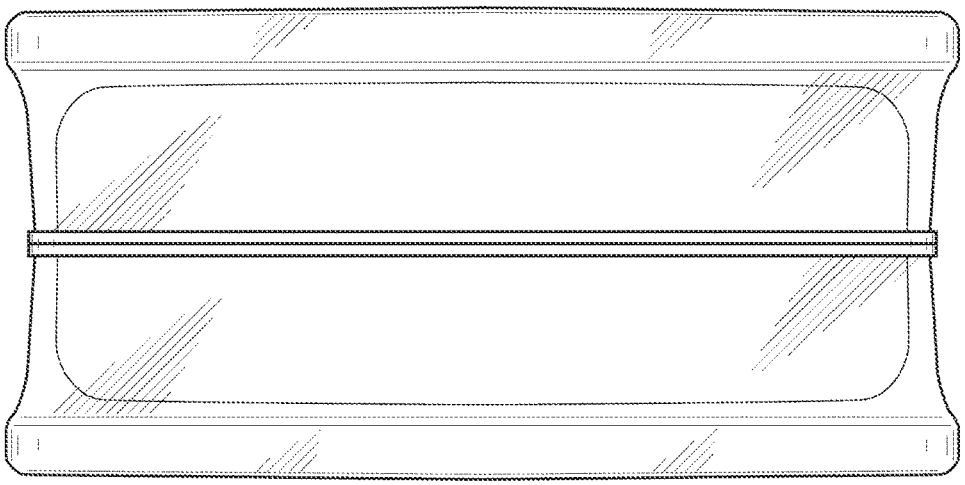

Stamping may also be a preferred method used to form the glass core 14. The stamping process may provide more dimensionally consistent glass cores 14. The thickness of the wall of the glass core 14 in particular is typically more consistent when formed by stamping. According to an example embodiment, the stamping process begins by placing hot glass into a die. The die can have any desired shape, depending on the shape of the component 10 to be formed. Next, the glass is stamped under pressure to accurately form one half of the glass core 14. The other half of the glass core 14 can be stamped after the first half. The edges of both halves are then heated until they reach a transition point. The two halves are then pressed together to form the stamped hollow core glass core 14. An example of the hollow glass core 14 formed by stamping is shown in FIGS. 5A and 5B.

Another aspect of the invention provides the component 10 including the hollow core 12 manufactured by the high pressure vacuum die casting process which employs the glass core 14, as described above. The component 10 is formed of metal, which is typically aluminum or an aluminum alloy, but can be another type of metal. The component 10 also includes the hollow core 12 formed using the glass core 14, as described above. The component 10 formed is typically designed for use in a vehicle, for example the component 10 can be a cradle, rail, A-pillar, twist axle, control arm, or shock tower.

Figure 6:
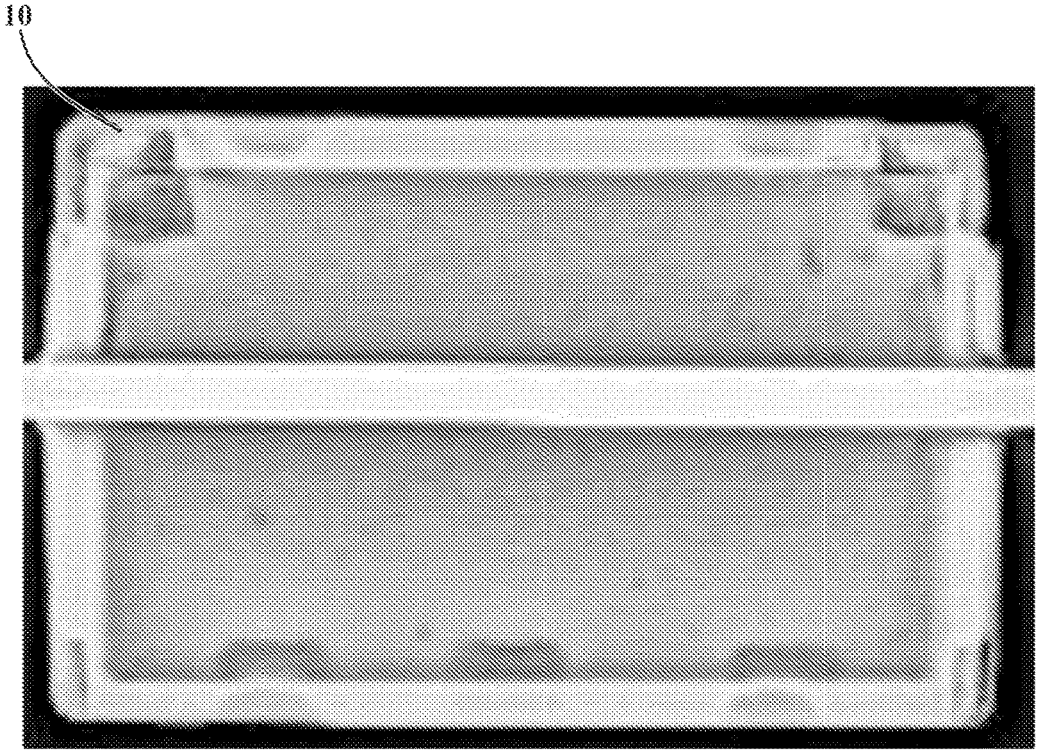
FIG. 6 is cross-sectional view of a component formed using a stamped glass core according to an example embodiment.

The component 10 formed by the high pressure vacuum die casting process which employs the glass core 14, as described above, has numerous benefits. First, the process used to form the component 10 is cost effective. The component 10 also has reduced mass compared to the same component 10 formed by other methods, such as an open section cradle formed of aluminum by high pressure die casting (HPDC) without the glass core 14 or open section aluminum formed by low pressure die casting (LPDC). A mass savings of about 40% has been found compared to the open section cradle formed by high pressure die casting without the glass core 14. The reason the component 10 formed by the high pressure vacuum die casting process with the glass core 14 can be lighter is that the geometric shapes that can be achieved are stronger than open sections. The component 10 typically has a wall thickness and material properties similar to the same components formed by the other methods. FIG. 6 is a cross-sectional view of a component 10 formed using the stamped glass core 14. The component has a wall thickness of 1 mm to 5 mm, more specifically 3 mm.

Figure 7:
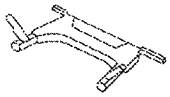
FIG. 7 is a table summarizing mass savings potential which can be achieved by the high pressure vacuum die casting process with the glass core according to example embodiments.
Figure 7:
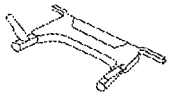
Figure 7:
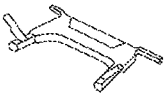
Figure 7:
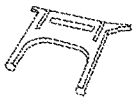

FIG. 7 is a Table showing mass savings potential that can be achieved by the high pressure vacuum die casting process with the glass core 14.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed is:

1. A method of manufacturing a component, comprising the steps of:

placing a glass core in a die cavity of a high pressure vacuum die casting apparatus;

injecting metal into the die cavity around the glass core;

casting the metal in the die cavity under a pressure of 1 Bar to 500 Bar and under a vacuum to form a cast component, the cast component having a wall thickness ranging from 1 mm to 5 mm, wherein, prior to the casting step, the method includes reducing potential for breakage of the glass core during the casting step by at least one of: preheating the glass core prior to the casting step; forming the glass core from fused silica glass or borosilicate glass; and forming the glass core such that the glass core is a wall having a consistent glass thickness surrounding an opening, shattering and removing the glass core from the component after the casting step, and reusing and/or recycling the glass core after the step of removing the glass core from the component.

2. The method of claim 1, wherein the shattering step includes breaking the glass core into pieces which do not include shards.

3. The method of claim 1 further including blowing or stamping glass to form the glass core before placing the glass core in the die cavity.

4. The method of claim 1, wherein the metal is aluminum or an aluminum alloy.

5. The method of claim 1, wherein glass of the glass core further includes at least one of soda lime, fused quartz, and alumina.

6. The method of claim 1, wherein the component is a cradle, rail, A-pillar, twist axle, control arm, or shock tower.

7. The method of claim 1, wherein the component includes a hollow core after the casting and after removing the glass core from the component.

8. The method of claim 1, wherein the glass core has the consistent glass thickness, and the consistent glass thickness is in a range of 3 mm to 7 mm.

9. The method of claim 1, wherein an insulating coating is disposed on the glass core.

* * * * *